US006396485B1

(12) United States Patent
Minami

(10) Patent No.: US 6,396,485 B1
(45) Date of Patent: May 28, 2002

(54) DISPLAY APPARATUS WITH DRIVE CIRCUIT CAPABLE OF REDUCING POWER CONSUMPTION

(75) Inventor: Masahiro Minami, Kanagawa (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/306,412

(22) Filed: May 6, 1999

(30) Foreign Application Priority Data

May 20, 1998 (JP) ..... 10-138409

(51) Int. Cl.[7] ..... G09G 5/00

(52) U.S. Cl. ..... 345/204; 345/50; 345/87; 345/90; 345/96; 345/98; 345/99; 345/100; 345/208; 345/212; 345/214

(58) Field of Search ..... 345/87, 96, 98–100, 345/208–214, 50, 204

(56) References Cited

U.S. PATENT DOCUMENTS 4,802,739 A * 2/1989 Iwamoto ..... 345/87
5,841,412 A * 11/1998 Ebihara ..... 345/58
5,859,627 A * 1/1999 Hoshiya et al. ..... 345/100
6,100,867 A * 8/2000 Gyouten ..... 345/95
6,195,077 B1 * 2/2001 Gyouten et al. ..... 345/99

FOREIGN PATENT DOCUMENTS

| | | |
|---|---|---|
| JP | 4-67122 | 3/1992 |
| JP | 8-76083 | 3/1996 |
| JP | 9-230829 | 9/1997 |
| JP | 9-236790 | 9/1997 |
| JP | 9-243998 | 9/1997 |
| JP | 9-258175 | 10/1997 |

* cited by examiner

*Primary Examiner*—Richard Hjerpe
*Assistant Examiner*—Henry N. Tran
(74) *Attorney, Agent, or Firm*—Young & Thompson

(57) ABSTRACT

A display apparatus includes a display panel and a logic switch unit. The display panel has a plurality of common electrodes and a plurality of segment electrode arranged in a direction orthogonal to the plurality of common electrodes. Display cells are formed at intersections of the plurality of common electrodes and the plurality of segment electrodes. The logic switch unit short-circuits selected at least one of the plurality of common electrodes corresponding to a display cell group and selected ones of the plurality of segment electrodes corresponding to the display cell group in response to a common-segment short-circuit timing signal. The display cell group includes selected ones of the display cells.

19 Claims, 10 Drawing Sheets

DISPLAY APPARATUS WITH DRIVE CIRCUIT CAPABLE OF REDUCING POWER CONSUMPTION

BACKGROUND OF THE INVENTION

1. Field of the Invention

The present invention generally relates to a display apparatus with a drive circuit, and more specifically, to a line inverting drive type display apparatus with a drive circuit in which power consumption can be reduced.

2. Description of the Related Art

A display apparatus such as a liquid crystal display (LCD) apparatus is widely used in various electronic appliances such as mobile communication terminals. A long time operation is required in the display apparatus using a battery. Therefore, power consumption required to drive the display apparatus should be reduced.

As typical liquid crystal display (LCD) drive systems, a line inverting drive system and a frame inverting drive system are well known in the field. In both LCD drive systems, a polarity of voltage applied between electrodes is switched at a timing when a line or a frame is switched. The reason why the switching of polarity of applied voltage is required is given as follows. That is, when a voltage having the same polarity is continuously applied to a LCD cell, a characteristic of the LCD cell is deteriorated.

FIGS. 1A to 1D are timing charts showing electrode drive timing performed in accordance with the line inverting drive system. In the line inverting drive system, the polarity of a voltage applied between a common electrode and a segment electrode is inverted for every scanning line. Similarly, FIGS. 2A to 2C are timing charts showing electrode drive timing in the frame inverting drive system. In the frame inverting drive system, the polarity of a voltage applied between a common electrode and a segment electrode is inverted for every field. In the figures, symbol COMm (symbol "m" is an integer) shows the voltage level of the common electrode, and symbol SEGn (symbol "n" is an integer) represents the voltage level of the segment electrode. In FIGS. 1A to 1D and FIGS. 2A to 2C, the respective voltage levels are indicated over two frame periods.

Japanese Laid Open Patent Application (JP-A-Heisei 4-67122) describes the technique in which a flicker problem can be eliminated and also a transistor element can be made compact in the LCD element drive system. Also, Japanese Laid Open Patent Application (JP-A-Heisei 8-76083) describes the technique in which a stable operation period can be made long and also a cross-talk can be reduced in the LCD drive apparatus. Furthermore, Japanese Laid Open Patent Application (JP-A-Heisei 9-230829) discloses the technique of a source driver output circuit for driving for a short time in a high power usage efficiency. In addition, Japanese Laid Open Patent Application (JP-A-Heisei 9-236790) describes the technique for reducing a cross-talk in the LCD display device.

FIG. 3 is a block diagram showing a conventional liquid crystal display (LCD) drive circuit of the line inverting drive system. The conventional LCD drive circuit is composed of a power supply circuit 201, a timing generator 203, a common electrode selecting circuit 205, a common signal generating circuit 207, a segment signal generating circuit 209, a first switch unit 211, and a second switch unit 213.

The first switch unit 211 is composed of switch pairs corresponding to common electrodes, respectively. The different voltages are applied to each of switches SWDm and SWEm of each switch pair. The second switch unit 213 is composed of switch pairs corresponding to segment electrodes, respectively. The different voltages are applied to each of switches SWFn and SWGn of each switch pair.

FIGS. 4A to 4F are timing charts of the LCD drive circuit shown in FIG. 3. The timing generator 203 divides a clock signal 215 of FIG. 4A in frequency to produce a frequency-divided clock signal 217, as shown in FIG. 4B. The frequency-divided clock signal 217 specifies line inverting drive timing.

In response to the frequency-divided clock signal 217, the first switch unit 211 and the second switch unit 213 may switch each of the switch pairs. For example, when the common electrode COM1 is selected in a selection period "t2" of FIG. 4D, the voltage applied to the common electrode COM1 changes at the line inverting timing "t1", as shown in FIG. 4E. Similar to the common electrode, the voltage applied to the segment electrode is changed. It should be noted that only segment electrode "SEG1" is shown in FIG. 4F.

In the liquid crystal display apparatus of the line inverting drive system, the polarity of the voltage applied between the electrodes is inverted for every line. At the timing "t1" when the polarity is inverted, charges stored between the electrodes are previously discharged. Also, the power is consumed based on the voltage level required to be inverted.

SUMMARY OF THE INVENTION

An object of the present invention is to provide a display apparatus with a drive circuit in which power consumption can be reduced.

Another object of the present invention is to provide a liquid crystal display drive circuit in which power consumption can be reduced at a timing when the polarity of a voltage applied between electrodes is switched.

Still another object of the present invention is to provide a liquid crystal display drive circuit in which power consumption can be reduced by adding a simple circuit.

In order to achieve an aspect of the present invention, a display apparatus includes a display panel and a logic switch unit. The display panel has a plurality of common electrodes and a plurality of segment electrode arranged in a direction orthogonal to the plurality of common electrodes. Display cells are formed at intersections of the plurality of common electrodes and the plurality of segment electrodes. The logic switch unit short-circuits selected ones of the plurality of common electrodes corresponding to a display cell group and selected ones of the plurality of segment electrodes corresponding to the display cell group in response to a common-segment short-circuit timing signal. The display cell group includes selected ones of the display cells.

The logic switch unit preferably short-circuits the selected segment electrodes in response to a segment short-circuit timing signal, before the selected common electrodes and the selected segment electrodes are short-circuited.

Also, a number of the selected common electrodes is 1, and the common-segment short-circuit timing signal is generated before a line inverting operation to the common electrode.

The common-segment short-circuit timing signal is generated such that electric charge stored between the selected common electrode and the selected segment electrodes is redistributed.

It is preferable that the selected common electrode is electrically disconnected from the selected segment electrodes, when the stored charge substantially reaches a preset value.

In order to achieve another aspect of the present invention, a liquid crystal display drive circuit for driving a display panel which has a plurality of common electrodes and a plurality of segment electrode arranged in a direction orthogonal to the plurality of common electrodes. The liquid crystal display drive circuit includes a timing control unit, a common electrode driving unit, a segment electrode drive unit and a logic switch unit. The timing control unit frequency-divides a clock signal to generate a first timing signal and a second timing signal from the frequency-divided clock signal, and inputs a display data to output a segment data corresponding to the plurality of segment electrodes. The common electrode drive unit generates a common selection signal based on the frequency-divided clock signal and the first timing signal to select one of the plurality of common electrodes. Also, the common electrode drive unit generates a common drive signal used to drive the selected common electrode with a selected one of a plurality of first levels. The segment electrode drive unit generates a segment drive signal used to drive each of the plurality of segment electrodes with a selected one of a plurality of second levels. The logic switch unit responds to the common selection signal and the second timing signal to electrically disconnect the selected common electrode from the common drive signal, and to electrically disconnect the plurality of segment electrodes from the segment drive signal. Then, the logic switch unit responds to the common selection signal and the second timing signal to short-circuit the common electrode and the plurality of segment electrodes.

The first timing signal is preferably generated to start a line inverting operation to the selected common electrode, and the second timing signal is preferably generated such that the selected common electrode is short-circuited to the plurality of segment electrodes before the line inverting operation.

The timing control unit may include a frequency dividing unit, a first delay unit and a second timing signal generating unit. The frequency dividing unit frequency-divides the clock signal to generate the frequency-divided clock signal based on a preset value. The first delay unit delays the frequency-divided clock signal based upon a preset time to output the first timing signal. The second timing signal generating unit generates the second timing signal based on the frequency-divided clock signal and the first timing signal such that the second timing signal is activated in synchronous with the frequency-divided clock signal. The first timing signal is generated while the second timing signal is activated.

The segment data are supplied to the segment electrode drive unit in parallel in correspondence with the plurality of segment electrodes.

Also, two different voltage levels may be allocated to the common drive signal for the selected first level, and a voltage level of the common drive signal may be changed in response to a falling timing of the second timing signal. Also, two different voltage levels may be allocated to the segment drive signal for the selected second level, and a voltage level of the segment drive signal may be changed in response to a falling timing of the second timing signal.

The logic switch unit includes a first disconnecting unit, a first short-circuit unit, a disconnect instruction generating unit, a second disconnecting unit and a second short-circuit unit. The first disconnecting unit electrically disconnects the plurality of segment electrodes from the segment drive signal in response to the second timing signal. The first short-circuit unit short-circuits the plurality of segment electrodes to each other in response to the second timing. The disconnect instruction generating unit generates a disconnect instruction based on the second timing signal and the common selection signal. The second disconnecting unit electrically disconnects the selected common electrode from the common drive signal in response to the disconnect instruction. The second short-circuit unit short-circuits the selected common electrode to the plurality of segment electrodes in response to the disconnect instruction.

In order to achieve still another aspect of the present invention, a liquid crystal display drive circuit for driving a display panel which has a plurality of common electrodes and a plurality of segment electrode arranged in a direction orthogonal to the plurality of common electrodes. The liquid crystal display drive circuit includes a timing control unit, a common electrode drive unit, a segment electrode drive unit and a logic switch unit. The timing control unit frequency-divides a clock signal to generate a first timing signal and a second timing signal from the frequency-divided clock signal, and inputs a display data to output a segment data corresponding to each of the plurality of segment electrodes. The common electrode drive unit generates a common selection signal based on the frequency-divided clock signal and the first timing signal to select one of the plurality of common electrodes. Also, the common electrode drive unit generates first and second common drive signals used to alternately drive the selected common electrode with a selected one of a plurality of first levels. The segment electrode drive unit generates a segment drive signal used to drive each of the plurality of segment electrodes with a selected one of a plurality of second levels. The logic switch unit electrically disconnects the selected common electrode from the first and second common drive signals in response to the first and second timing signals. Also, the logic switch unit electrically disconnects the plurality of segment electrodes from the segment drive signal based on the common selection signal and the second timing signal. Then, the logic switch unit short-circuits the selected common electrode and the plurality of segment electrodes.

The first timing signal is preferably generated to start a line inverting operation to the selected common electrode, and the second timing signal is preferably generated such that the selected common electrode is short-circuited to the plurality of segment electrodes before the line inverting operation.

The timing control unit includes a frequency dividing unit, a first delay unit and a second timing signal generating unit. The frequency dividing unit frequency-divides the clock signal to generate the frequency-divided clock signal based on a preset value. The first delay unit delays the frequency-divided clock signal based upon a preset time to output the first timing signal. The second timing signal generating unit generates the second timing signal based on the frequency-divided clock signal and the first timing signal such that the second timing signal is activated in synchronous with the frequency-divided clock signal. The first timing signal is generated while the second timing signal is activated.

The segment data are supplied to the segment electrode drive unit in parallel in correspondence with the plurality of segment electrodes. The first and second common drive signals are alternatively switched based on the first and second timing signals.

Two different voltage levels are preferably allocated to the segment drive signal for the selected second level, and a voltage level of the segment drive signal is preferably changed in response to a falling timing of the second timing signal.

The logic switch unit may include a first disconnecting unit, a first short-circuit unit, a disconnect timing generating unit, a second disconnecting unit and a short-circuit instruction generating unit. The first disconnecting unit electrically disconnects the plurality of segment electrodes from the segment drive signal in response to the second timing signal. The first short-circuit unit short-circuits the plurality of segment electrodes to each other in response to the second timing. The disconnect timing generating unit generates first and second disconnect instructions based on the first and second timing signals. The second disconnecting unit electrically disconnects the selected common electrode from the first and second common drive signals in response to the first and second disconnect instructions. The short-circuit instruction generating unit generates a short-circuit instruction based on the second timing signal and the common selection signal such that the selected common electrode to the plurality of segment electrodes are short-circuited to each other in response to the short-circuit instruction.

DESCRIPTION OF THE PREFERRED EMBODIMENTS

A display apparatus such as a liquid crystal display apparatus with a drive circuit of the present invention will now be described in detail in conjunction with the attached drawings.

Figures 1A, 1B, 1C, 1D:
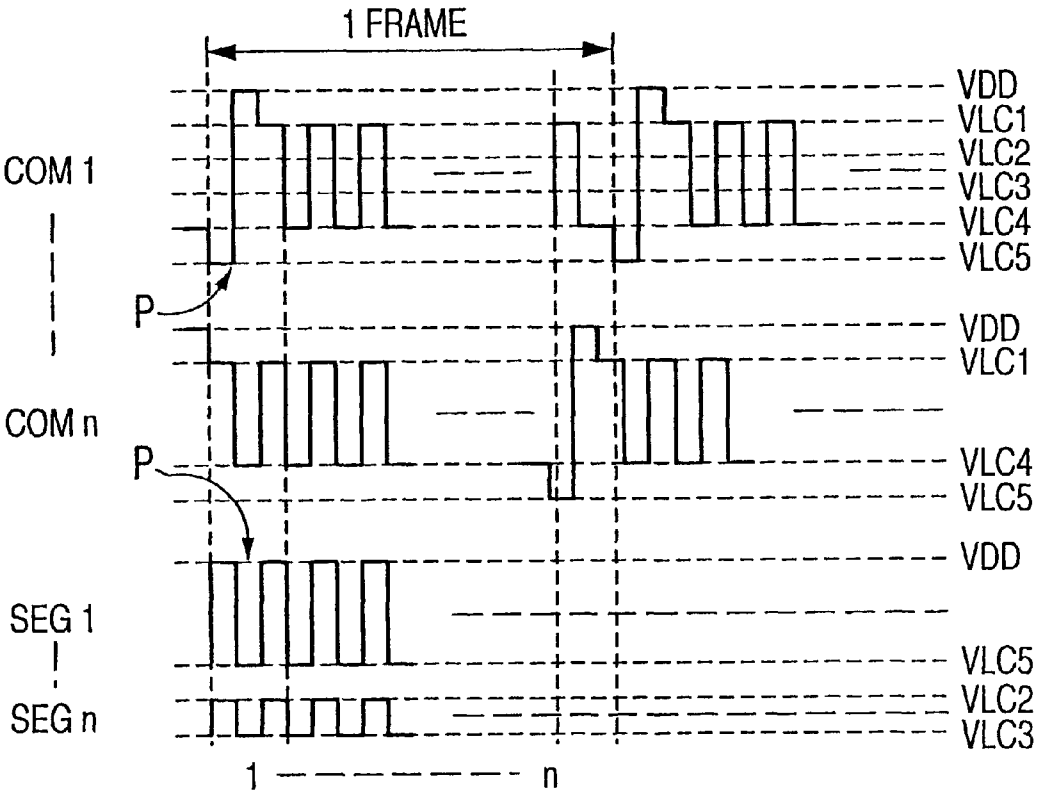
Fig. 1A PRIOR ART
Fig. 1B PRIOR ART
Fig. 1C PRIOR ART
Fig. 1D PRIOR ART
FIGS. 1A to 1D are timing charts for explaining for a conventional liquid crystal display drive circuit of a line inverting drive system.
Figures 2A, 2B, 2C:
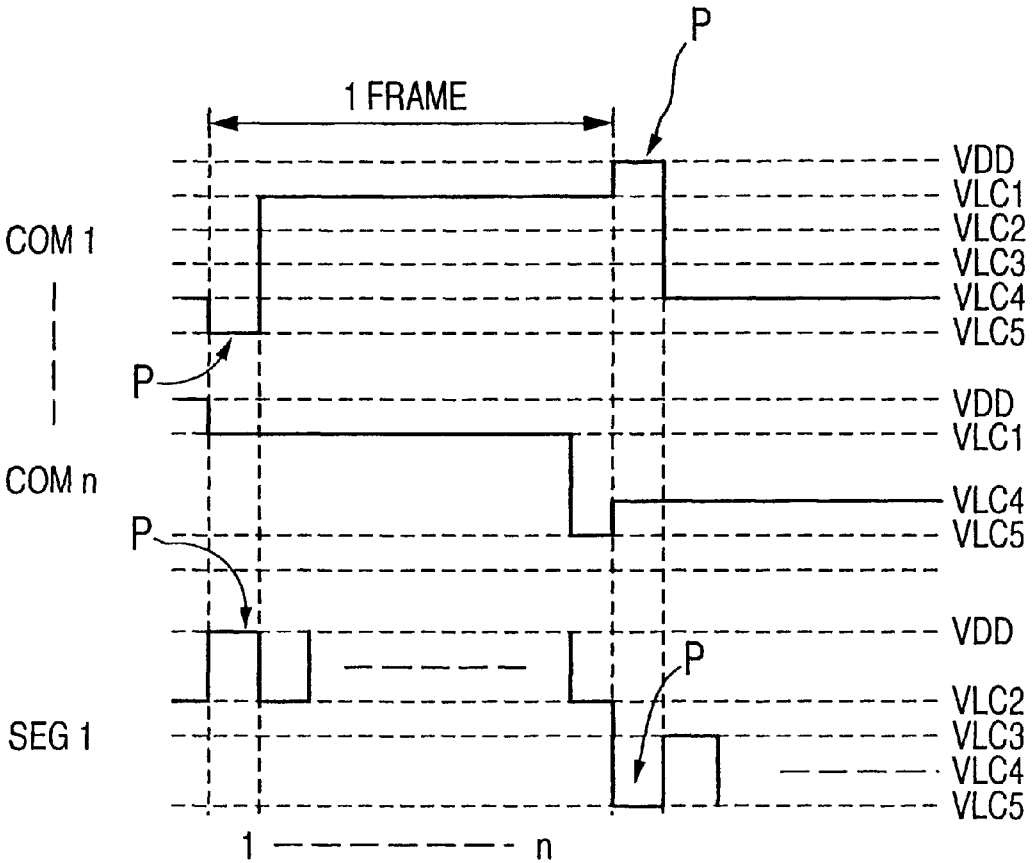
Fig. 2A PRIOR ART
Fig. 2B PRIOR ART
Fig. 2C PRIOR ART
FIGS. 2A to 2C are timing charts for explaining another conventional liquid crystal display drive circuit of a frame inverting drive system.
Figure 3:
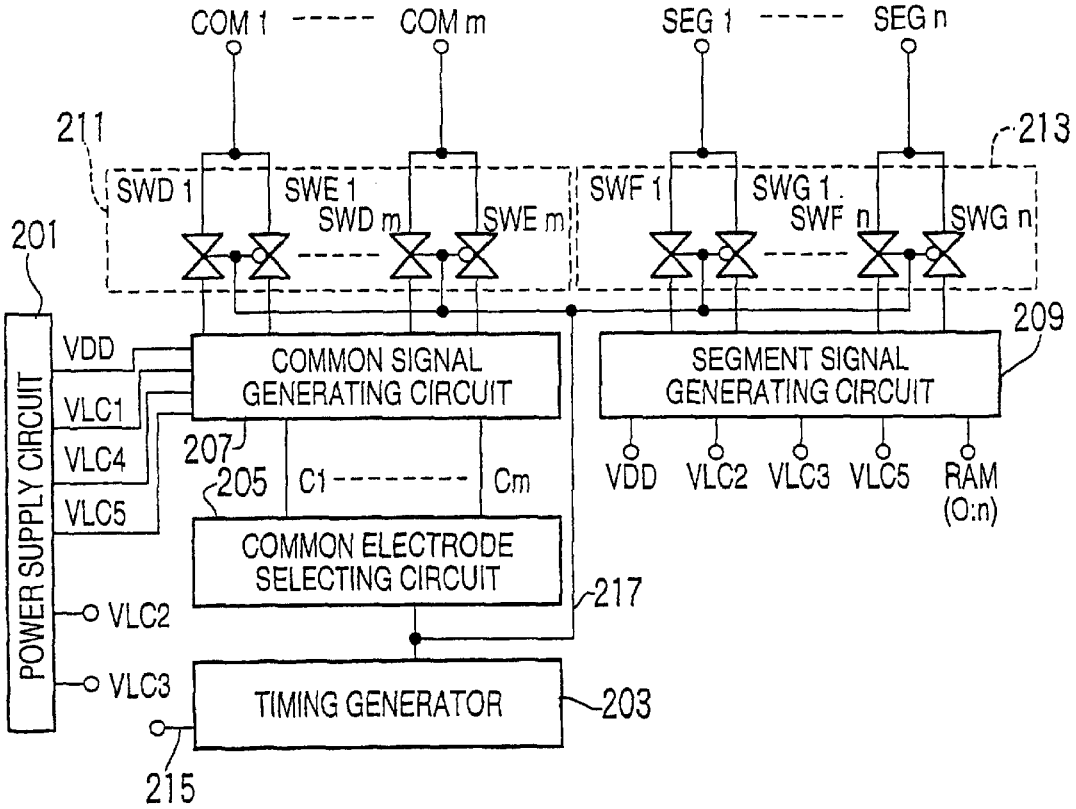
Fig.3 PRIOR ART
FIG. 3 is a block diagram illustrating the structure of a conventional liquid crystal display drive circuit operable of the line inverting drive system.
Figures 4A, 4B, 4C, 4D, 4E, 4F:
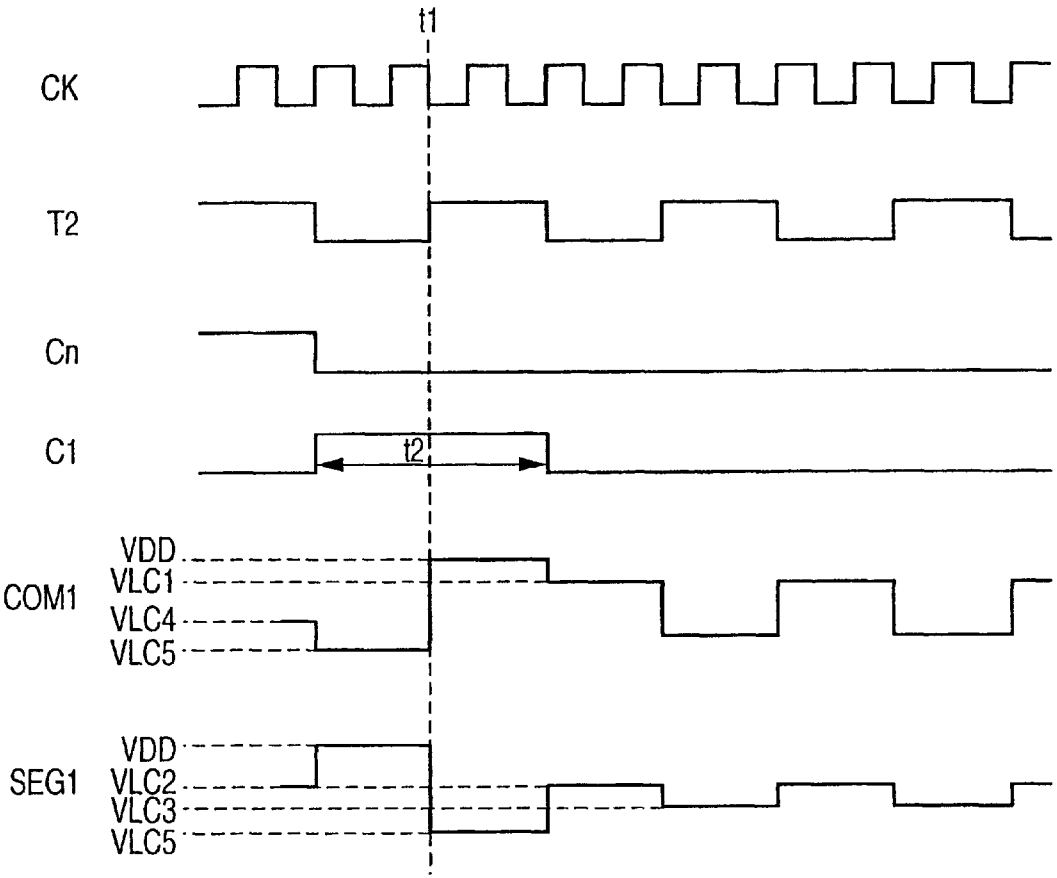
Fig. 4A PRIOR ART
Fig. 4B PRIOR ART
Fig. 4C PRIOR ART
Fig. 4D PRIOR ART
Fig. 4E PRIOR ART
Fig. 4F PRIOR ART
FIGS. 4A to 4F are timing charts for explaining the operation of the conventional liquid crystal display drive circuit shown in FIG. 3.
Figure 5A:
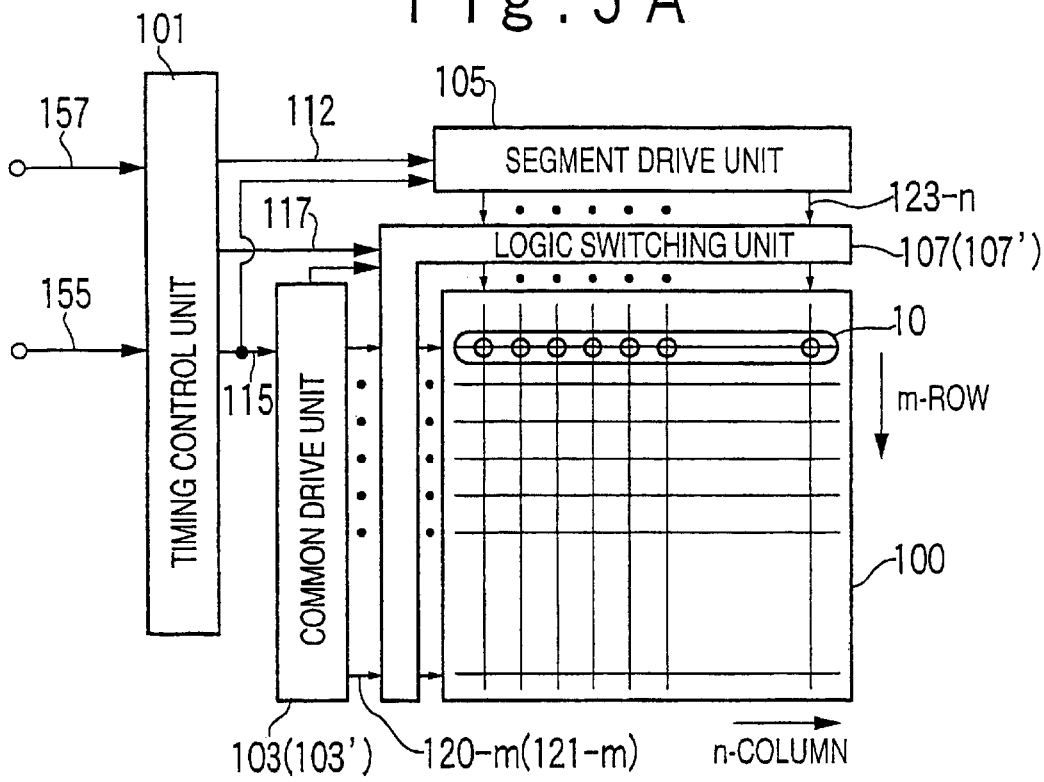
FIG. 5A is a block diagram illustrating the structure of a liquid crystal display apparatus of the present invention.

FIG. 5A shows the circuit structure of the liquid crystal display (LCD) apparatus with a drive circuit of the present invention. The liquid crystal display apparatus is composed of a timing control unit 101, a common drive unit 103 (103'), a segment drive unit 105, a logic switching unit 107 (107') and a liquid crystal display (LCD) panel 100 as a display panel.

The display panel 100 is a structural member including two glass substrates, i.e., first and second glass substrates. A plurality of electrodes are formed on each of the first and second substrates. The plurality of electrodes formed on the first glass substrate are provided to be perpendicular to those formed on the second glass substrate when the first and second glass substrates oppose to each other. The present invention can be applied to a display apparatus with a display panel having such a structure.

The LCD apparatus shown in FIG. 5A is composed of m (m is an integer equal to or more than 2) common electrodes and n (n is an integer equal to or more than 2) segment electrodes. When one common electrode and one segment electrode are selected, a liquid crystal cell is specified and is indicated by a circle in FIG. 5A. When one or more common electrodes, one in this example is selected and a plurality of segment electrodes are selected, a liquid crystal cell group 10 is specified by the selected common electrode and the plurality of segment electrodes.

Figure 5B:
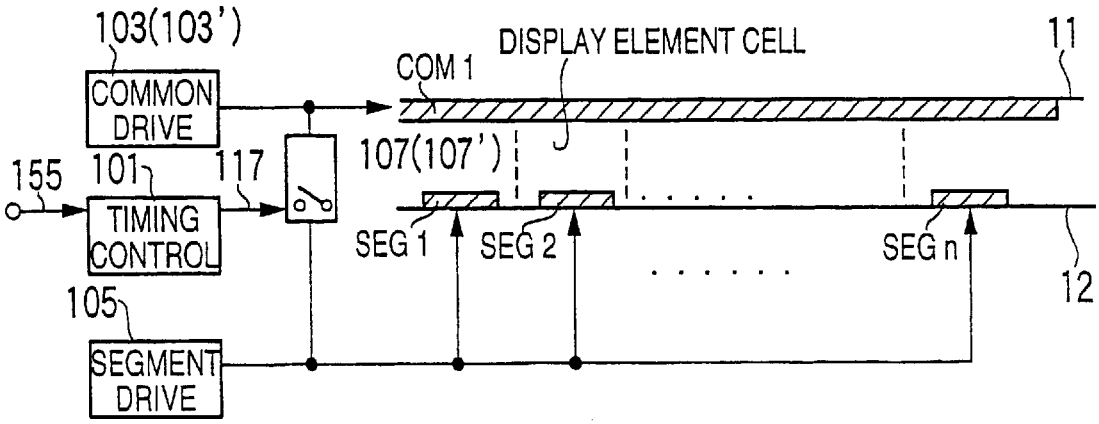
FIG. 5B is a conceptional diagram showing a function of the LCD drive circuit of the present invention.

FIG. 5B is a conceptional diagram showing a function of the LCD apparatus according to the present invention. The m common electrodes are formed on the first glass substrate 11, and the n segment electrodes are formed on the second glass substrate 12. In FIG. 5B, for example, the common electrode COM1 is selected and the segment electrodes SEG1 to SEGn are selected to form the liquid crystal cell group 10.

In response to a timing signal 117, a logic switching unit 107 (107') forms a short-circuit between a plurality of segment electrodes SEG1 to SEGn and the selected common electrode COM1. It should be noted that the common drive unit 103 (103') is electrically disconnected from the selected common electrode COM1 substantially at the same time when the above-described short-circuit is formed by the logic switching unit 107 (107'). Also, the segment drive unit 105 is electrically disconnected from the n segment electrodes SEG1 to SEGn substantially at the same time when the above-described short-circuit is formed by the logic switching unit 107 (107'). As a consequence, charges stored between the selected common electrode COM1 and the n segment electrodes SEG1 to SEGn are redistributed through the formation of the above-explained short-circuit.

When an equivalent model is applied to a liquid crystal cell, it could be considered that the liquid crystal cell is a capacitor element which has a common electrode and a segment electrode. In a LCD drive circuit, a voltage is applied to a selected common electrode and a selected segment electrode. If the voltage of the selected common electrode is increased from a voltage level VLC5 to another voltage level VDD, the voltage level of the segment electrode is conversely decreased from the voltage level VDD to the voltage level VLC5. Thus, the polarity of the applied voltage is inverted. That is, under a display condition immediately before a line inversion drive, the voltage level of the selected common electrode is equal to VLC5 and the voltage level of the selected segment electrode is equal to VDD. As a result, when a capacitance of the liquid crystal cell is equal to "C", an electric charge "Q" stored between the selected common electrode and the selected segment electrode is expressed by the following equation (1)

$$Q=C^{*}(VDD-VLC5) \quad (1)$$

It is supposed that both of the selected common electrode and the selected segment electrode are electrically disconnected from the liquid crystal display drive circuit, and a short-circuit is formed between the selected common electrode and the selected segment electrode. At this time, if the voltage level after the formation of the short-circuit is equal to VSH, the electric charge "Q" is expressed by the following formula (2)

$$Q=C^*(VDD-VSH)+C^*(VSH-VLC5) \quad (2)$$

Based upon the above-described equations (1) and (2), $$(VDD-VSH)=C^*(VSH-VLC5).$$

In a case that the electric charges are equal to "QSH", $$Q=2^*QSH,\ QSH=Q/2 \quad (3)$$

As apparent from the foregoing description, while the common electrode is short-circuited with the segment electrode, a charge amount of Q/2 is redistributed and the remaining charge amount of Q/2 is supplied from an external power supply circuit. As a result, the resultant power consumption can be essentially reduced by ½.

Moreover, the common electrode and the segment electrode in the above description may be arbitrarily selected. It is preferable that all of the segment electrodes may be selected, and the selected common electrode may be short-circuited with all of the selected segment electrodes. Now, all of the segment electrodes are selected in the below-mentioned description.

Figure 6:
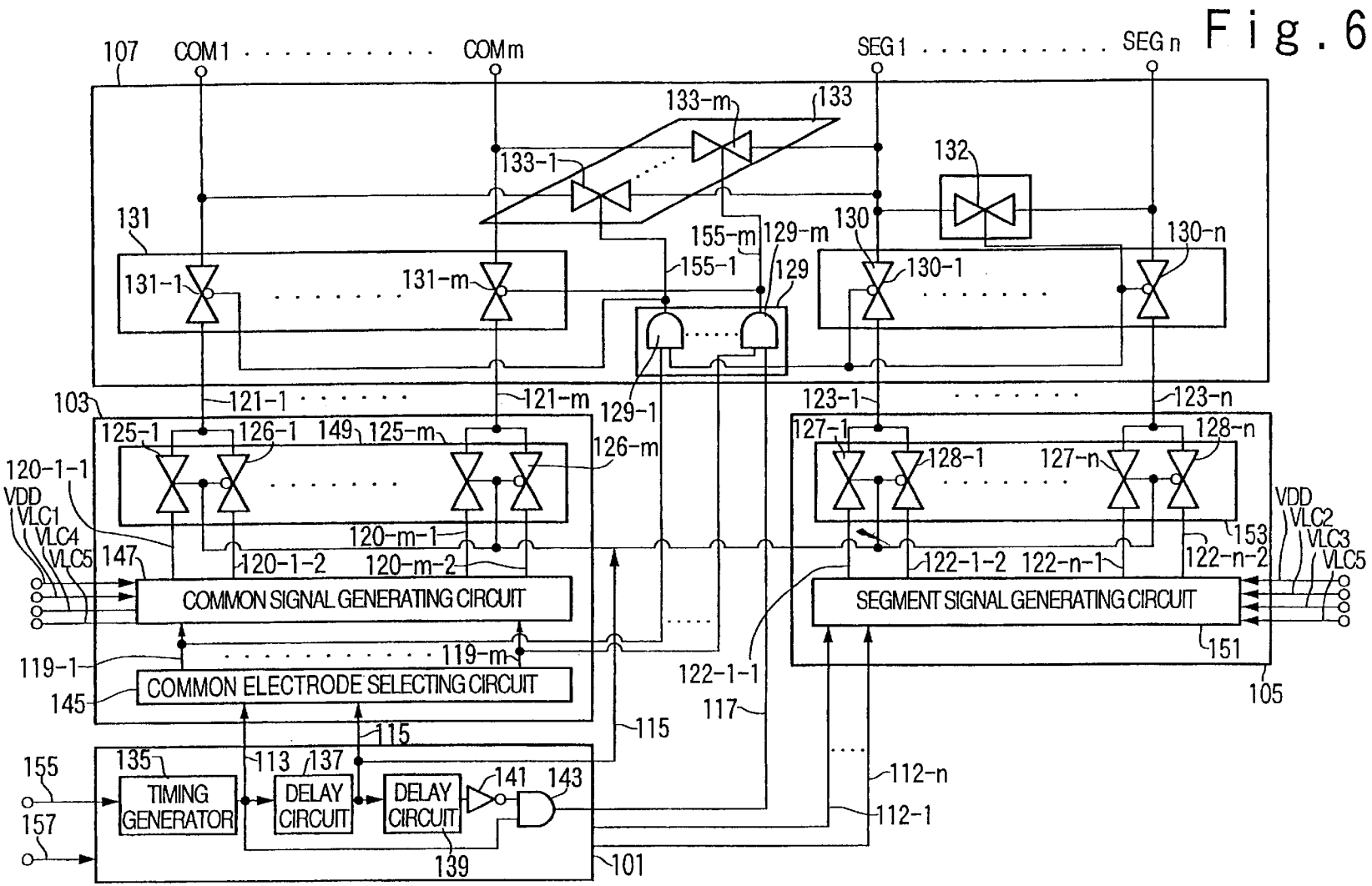
FIG. 6 is a block diagram illustrating the structure of a liquid crystal display apparatus including a drive circuit according to a first embodiment of the present invention.

FIG. 6 is a block diagram illustrating the circuit structure of the liquid crystal display (LCD) apparatus with the LCD drive circuit according to the first embodiment of the present invention. The LCD drive circuit in the first embodiment is composed of a timing control unit 101, a common drive unit 103, a segment drive unit 105, and a logic switching unit 107. It should be noted that the same reference numerals as those in FIGS. 5A and 5B are allocated to the same components as those in FIGS. 5A and 5B. It should also be noted that a common electrode COMm is selected as the above-explained "selected common electrode".

In the LCD drive circuit in the first embodiment, the timing control unit 101 divides a clock signal 155 in frequency to generate a frequency-divided clock signal 113. The frequency dividing ratio is set in relation to the frame frequency. The timing control unit 101 generates a first timing signal 115 and a second timing signal 117 from the frequency-divided clock signal 113. The first timing signal 115 gives a timing of a line inverting operation to the selected common electrode COMm. The second timing signal 117 gives a timing of inter-electrode short circuiting operation according to the present invention. In the inter-electrode short-circuiting operation, the selected common electrode COMm is short-circuited with a plurality of segment electrodes SEG1 to SEGn before the line inverting operation is executed. Also, the timing control unit 101 inputs a display data 157 to output segment data 112-1 to 112-n to the respective segment electrodes SEG1 to SEGn.

The timing control unit 101 is composed of a timing generating circuit 135, a delay circuit 137, another delay circuit 139, an inverter circuit 141, and an AND gate circuit 143. A second timing generating unit is composed of the delay circuit 139, the inverter circuit 141, and the AND gate circuit 143.

The timing generating circuit 135 inputs the clock signal 155 to generate the frequency-divided clock signal 113 based upon a frequency dividing ratio. The delay circuit 137 delays the frequency-divided clock signal 113 based on a preset time to output a first timing signal 115. The preset time is related to electric charge redistribution time which will be explained later.

The delay circuit 139 delays the frequency-divided clock signal 113 by a preset time. The inverter circuit 141 inverts an delayed clock signal outputted from the delay circuit 139. The AND gate circuit 143 inputs both of the output signal from the inverter 141 and the frequency-divided clock signal 113 to calculate a logical AND to output the second timing signal 117.

The rising timing of the second timing signal 117 is made substantially coincident with the rising timing of the frequency-divided clock signal 113. The first timing signal 115 rises at an intermediate timing during the high-level period of the second timing signal 117.

The common drive unit 103 is composed of a common electrode selecting circuit 145, a common signal generating circuit 147, and a first switch pair group 149. The first switch pair group 149 is composed of m first switch pairs corresponds to the m common electrodes, and each of the m first switch pairs is composed of switches 125-m and 126-m. The common electrode selecting circuit 145 selects one of the m rows, for example, m common electrodes COM1 to COMm of the LCD panel (see FIG. 5A). The common electrodes selecting circuit 145 inputs both of the frequency-divided clock signal 113 and the first timing signal 115 to activates one of selection signals 119-1 to 119-m, for example, the selection signal 119-m. In this example, the activated selection signal 119-m corresponds to the selected common electrode COMm. The activated selection signal 119-m is generated in response to the falling edge of the first timing signal 115.

The common signal generating circuit 147 inputs the activated selection signal 119-m and a plurality of first level signals (VDD, VLC1, VLC4, VLC5). The plurality of first level signals are supplied from a power supply circuit (not shown). The common signal generating circuit 147 allocates predetermined two of the plurality of first level signals to the activated selection signal 119-m as first level drive signals 120-m-1 and 120-m-2.

The first switch pair 125-m and 126-m corresponding to the common electrode COMm inputs the first level drive signals 120-m-1 and 120-m-2, and then outputs one of the signals as a common signal 121-m. The voltage level of the common signal 121-m is switched between the two voltage level signals in response to the first timing signal 115.

The segment drive unit 105 is composed of a segment signal generating circuit 151, and a second switch pair group 153. The second switch pair group 153 is composed of n second switch pairs corresponds to the n segment electrodes SEG1 to SEGn. The segment signal generating unit 151 inputs segment data signals 112-1 to 112-n in parallel and a plurality of second voltage level signals VDD, VLC2, VLC3, VLC5. The plurality of second voltage level signals are supplied from the power supply circuit (not shown). The segment signals generating circuit 151 allocates a predetermined one of the second voltage level signals to each of the segment data signals 112-1 to 112-n. These segment data signals 112-1 to 112-n are supplied to the segment drive unit 105 in parallel in correspondence with the respective segment electrodes SEG1 to SEGn. The segment signal generating unit 151 allocates two different voltage levels to each of the segment data signals 112-1 to 112-n as first and second segment signals 122-n-1 and 122-n-2.

The second switch pair of switches 127-n and 128-n corresponding to the segment electrode SEGn inputs the first segment signal 122-n-1 and the second segment signal 122-n-2, and then outputs one of the signals as a segment signal 123-n. The voltage level of the segment signal 123-n is switched in response to the first timing signal 115. The voltage level of the segment signal 123-n is switched in response to the falling timing of the first timing signal 115.

In response to the selection signal 119-m and the second timing signal 117, the logic switching unit 107 electrically disconnects the selected common electrode COMm from the common signal 121-m. Also, in response to the second timing signal 117, the logic switching unit 107 electrically disconnects the n segment electrodes SEG1 to SEGn from the segment signals 123-1 to 123-n.

The logic switching unit 107 forms a short-circuit between the disconnected common electrode COMm and the n disconnected segment electrodes SEG1 to SEGn. The logic switching unit 107 is composed of an AND gate circuit group 129, a first disconnection switch group 130, a second disconnection switch group 131, a first short-circuit switch 132, and a second short-circuit switch group 133.

The AND gate circuit group 129 is composed of AND gate circuits 129-1 to 129-m which correspond to the respective m common electrodes. The AND gate circuit 129-m input both of the second timing signal 117 and the selection signal 119-m to produce a disconnection instruction 155-m.

The second disconnection switch group 131 is composed of second disconnection switches 131-1 to 131-m corresponding to the common electrode COMm. The second disconnection switches 131-1 to 131-m are an analog switch. In response to the disconnection instruction 155-m, the second disconnection switch 131-m disconnects the selected common electrode COMm from the common signal 121-m.

The first disconnection switch group 130 is composed of first disconnection switches 130-1 to 130-n corresponding to the segment electrodes SEG1 to SEGn. The first disconnection switches 130-1 to 130-n are an analog switch. In response to the second timing signal 117, the first disconnection switch 130-n electrically disconnects the segment electrode SEGn from the segment signal 123-n.

The first short-circuit switch 132 short-circuits the n segment electrodes SEG1 to SEGn with each other in response to the second timing signal 117. The first short-circuit switch 132 is an analog switch..

The second short-circuit switch group 133 is composed of second short-circuit switch 133-1 to 133-m corresponding to the common electrode COM1 to COMm. In response to the disconnection instruction 155-m, the second short-circuit switch 133-m short-circuits the disconnected common electrode COMm and the n segment electrodes which are mutually short-circuited. The second short-circuit switches 131-1 to 133-m are an analog switch.

In the case that all of the n segment electrodes SEG1 to SEGn output turn-ON data immediately before the short-circuiting operation is carried out, as indicated in FIGS. 5A and 5B, all of the n segment electrodes hold the voltage level VDD. Also, the selected common electrode COMm holds the voltage level VLC5.

When these electrodes are short-circuited with each other, the electric charges transfer will occur, so that the voltage levels are averaged. While the LCD panel is driven after the next line inverting operation, the electrodes are energized such that the electrodes are charged only from the averaged voltage level to desirable voltage levels. As a result, the power consumption can be reduced.

In response to the second timing signal 117, the logic switching unit 107 opens the short-circuit between the common electrode COMm and the n segment electrodes SEG1 to SEGn. Furthermore, the logic switching unit 107 connects the common electrode COMm with the common signal 121-m, and also connects the n segment electrodes SEG1 to SEGn with the segment signals 123-1 to 123-n. In the case, in response to the second timing signal 115, the voltage levels of the common signal 121-m and the segment signals 123-1 to 123-n are previously updated.

It should be noted when the second timing signal 117 is generated, the first disconnection switch group 130 disconnects the segment signals 123-1 to 123-n from the corresponding segment electrodes SEG1 to SEGn, before the n segment electrodes are short-circuited with each other. As a consequence, the total number "m" of common electrodes needs not to be always equal to the total number "n" of segment electrodes.

FIGS. 7A to 7I are timing charts to explain the operations of the LCD drive circuit according to the first embodiment. In this example, the common electrode COM1 is selected.

Figures 7A, 7B, 7C, 7D, 7E, 7F, 7G, 7H, 7I:
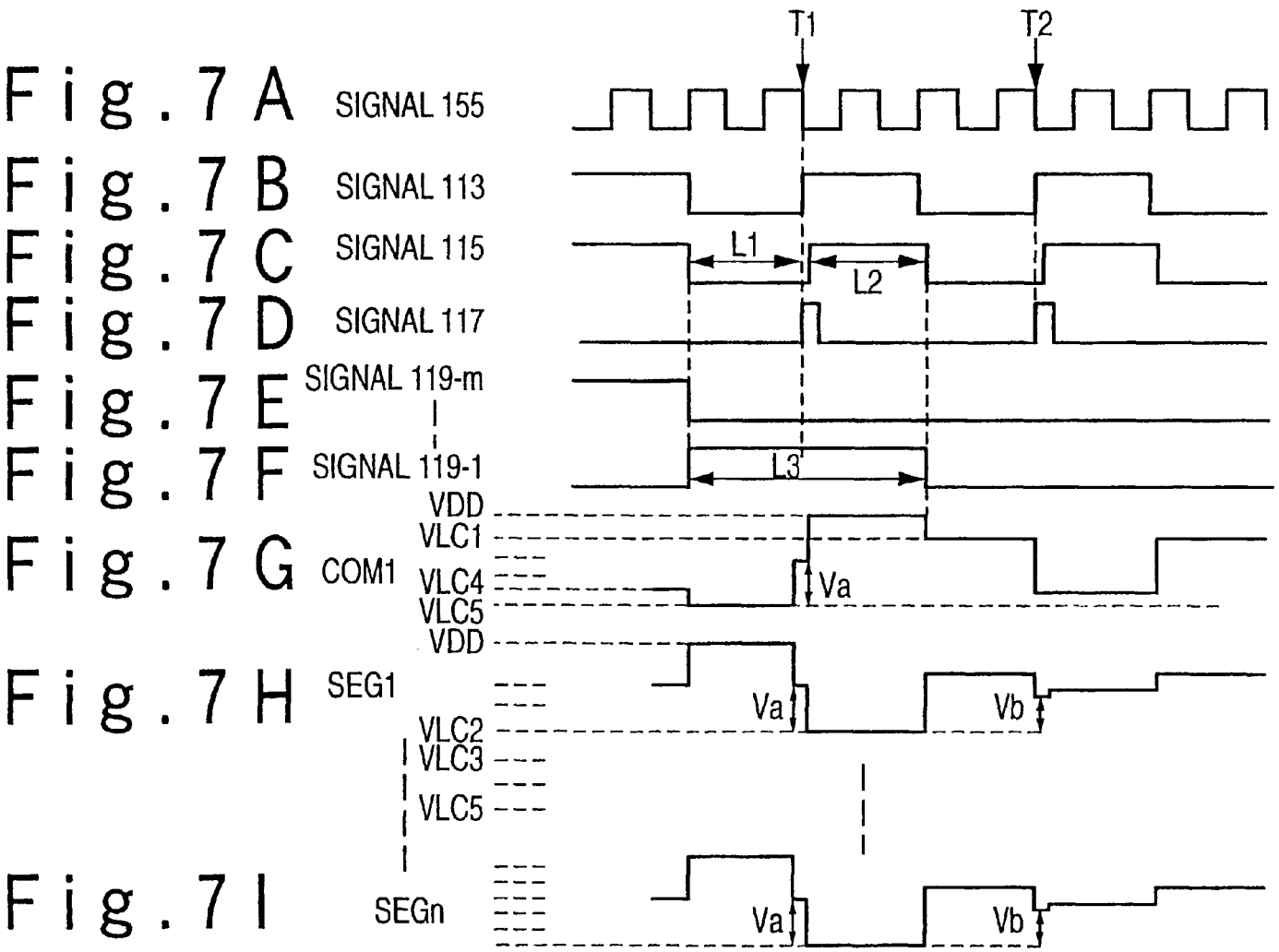
FIGS. 7A to 7I are timing charts to explain the operation of the liquid crystal display drive circuit shown in FIG. 6.

The timing generating circuit 135 inputs the clock signal 135 as shown in FIG. 7A to generate the frequency-divided clock signal 113 as shown in FIG. 7B. The delay circuit 137 delays the frequency-divided clock signal 113 to output the first timing signal 115 as shown in FIG. 7C. The first timing signal 115 gives the line inverting timing.

In response to the falling edge of the first timing signal 115, the common electrode selecting circuit 145 sequentially generates the selection signal 119-1 to 119-m for selection timings Ca, C2, - - - , Cm as shown in FIGS. 7E to 7F. The second timing signal 117 is an one-shot signal as shown in FIG. 7D and is used to detect the rising edge of the first timing signal 115.

The high-level period of the second timing signal 117 is formed based on the delay time of the delay circuit 137 and the delay time of the delay circuit 139. The rising time of the first timing signal 115 is set near a center portion within the high-level period of the second timing signal 117.

Within a time period L1 during which the common electrode COM1 is selected, the first voltage level, i.e., a first common signal 120-1-1 of the common electrode COM1 is set to the voltage VDD. On the other hand, the second voltage level, i.e., a second common signal 120-1-2 is set to VLC5, as shown in FIG. 7G. The first voltage levels of the other common electrodes COM2 to COMm are set to the voltage VLC4, and the second voltage levels thereof are set to VLC1 (not shown).

Similarly, within a time period L1 during which the common electrode COMm is selected, the first voltage level of the common electrode COMm is set to the voltage VDD, whereas the second voltage level is set to the voltage VLC5. The first voltage levels of the other common electrodes COM1 to COMm-1 are set to the voltage VLC4, and the second voltage levels thereof are set to the voltage VLC1.

When the segment electrodes SEG1 to SEGn are in the ON states, the first voltage level, i.e., a first segment signal 122-n-i is set to the voltage VLC5 and the second voltage level, i.e., a second segment signal 122-n-2 is set to the voltage VDD within the time period L1. When the segment electrodes SEG1 to SEGn are in the OFF state, the first voltage level is set to the voltage VLC3 and the second voltage level is set to the voltage VLC2 within the time period L1. In the case that the second timing signal 117 is switched into a high level at the timing T1 within the time period L1 during which the common electrode COM1 is selected, the output signal 155-1 of the AND gate circuit 129-1 is set to a high level. As a result, the second disconnection switch 131-1 is set to the OFF state, and the second disconnection switches 131-2 to 131-M are set to the ON state. Also, the second short-circuit switch 133-1 is set to the ON state, and the second short-circuit switches 133-2 to 133-m are set to the OFF state. Furthermore, the first disconnection switches 130-1 to 130-n are set to the OFF state, and the first short-circuit switch 132 is set to the ON state.

Under the above-described condition, when all of the segment electrodes SEG1 to SEGn are set to the ON state, the voltage levels of the segment electrodes SEG1 to SEGn and the voltage levels of the selected common electrode COM1 become complementary. As a result, the averaged voltage Va is produced. In this case, the electric charges are merely redistributed and no consume current is produced.

Thereafter, in response to the falling timing of the second timing signal 117, the output signal 155-1 of the AND gate circuit 129-1 becomes a low level, the second disconnection switch 131-1 is set to the ON state, and the second short-circuit switch 133-1 is set to the OFF state. Also, the first disconnection switch 130-1 is set to ON state, and the first short-circuit switch 132 is set to the OFF state, The voltage level of the common electrode COM1 becomes the desirable voltage VDD from the voltage level Va, and the voltage level of the segment electrode SEG1 to SEGn becomes the desirable VLC5 from the voltage level Va. As a result, only power consumption from the voltage level Va to the desirable voltage level is required.

In a case that the segment electrodes SEG1 to SEGn are set to the OFF states, the voltage levels of the segment electrodes SEG1 to SEGn and the voltage level of the selected common electrode COM1 become complementary. As a result, the averaged voltage Vb is produced. In the case, the electric charges are merely transferred and no consume current is produced.

Thereafter, in response to the falling timing of the second timing signal 117, the output signal 155-1 of the AND gate circuit 129-1 becomes a low level, the second disconnection switch 131-1 is set to the ON state, and the second short-circuit switch 133-1 is set to the OFF state. Also, the first disconnection switches (130-1 to 130-n) are set to an ON state, and the first short-circuit switch 132 is set to the OFF state.

As explained above, similar to a case that the common electrode COM1 is set to the ON state, the voltage levels of the segment electrodes SEG1 to SEGn are set to the desirable voltage level VLC3 from the voltage level Vb. As a result, only power consumption from the voltage level Vb to the desirable voltage level is required.

It should be understood that the high-level period, namely, charges redistribution time period of the second timing signal 117 corresponds to a time period that the selected common electrode COM1 is short-circuited to all of the segment electrodes SEG1 to SEGn. While the above-explained electric charges are redistributed, the voltage level thereof become either the voltage Va or the voltage Vb. In the first embodiment, the charges redistribution time period is selected to be on the order of several tens of nsec. Similarly, when one of the other common electrodes COM2 to COMn is selected, the same operation is performed during the charges redistribution time period.

In the case that a portion of the n segment electrodes SEG1 to SEGn is selected, the first short-circuit switch 132 mutually short-circuits the portion of the n segment electrodes SEG1 to SEGn in response to the second timing signal 117. The logical denying (NOT) of the second timing signal 117 is deleted with respect to a portion of the first disconnection switches 130-1 to 130-n corresponding to the selected portion of the segment electrodes.

In accordance with the first embodiment, the selected common electrode is short-circuited to all of the segment electrodes within a predetermined time period before/after the line inverting timing. While the electric charges stored between the selected common electrode and all of the segment electrodes are utilized, the voltage level before the line is inverted is once brought into a voltage level approximated to a desirable voltage level, and then becomes the desirable voltage level. Therefore, the power consumption can be reduced.

Now, a specific example of the LCD apparatus according to the first embodiment will be described. As a display panel, when the LCD panel is sized by 100×32 bits, a total number of segment electrodes is 100, and a total number of common electrodes is 32. The frame frequency is set to 100 Hz. A capacitance of the LCD cell is assumed to be "C".

Figures 8A, 8B, 8C, 8D:
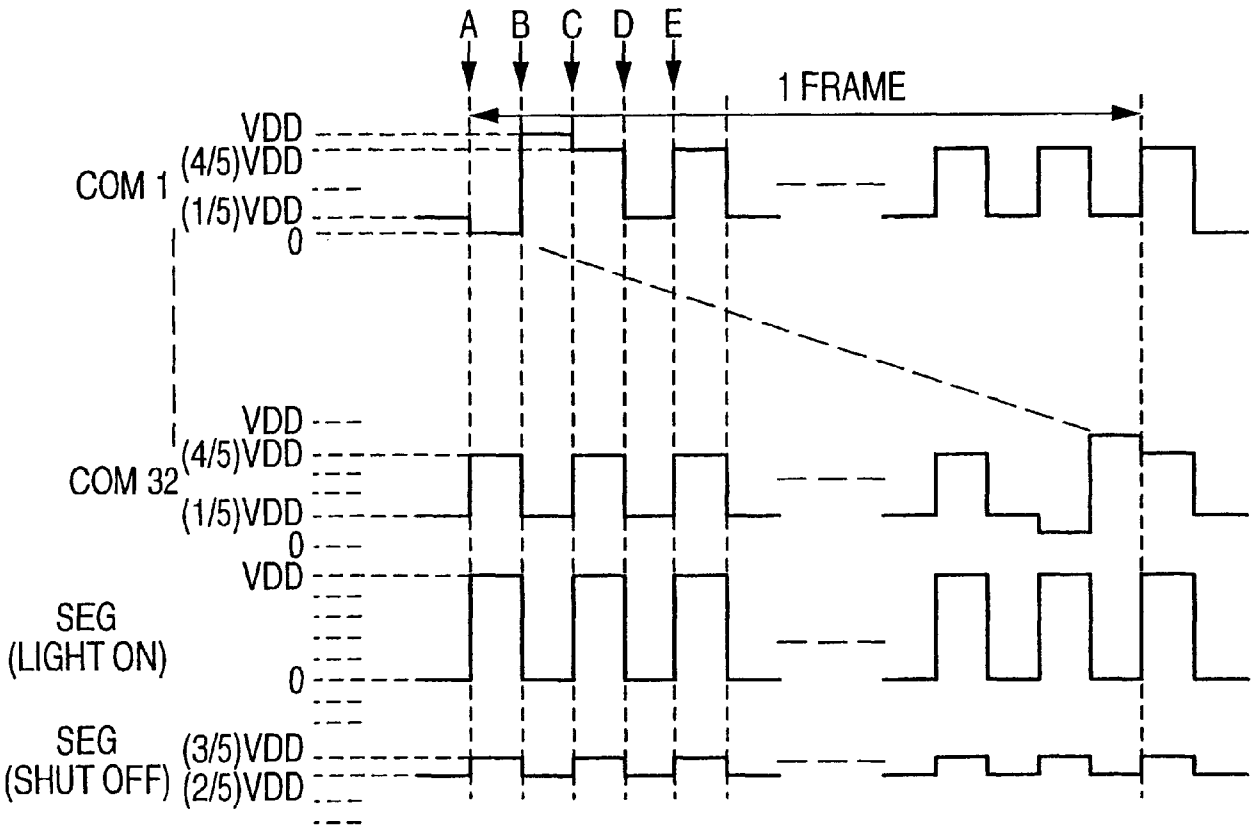
FIGS. 8A to 8D are timing charts to explain the effect of the liquid crystal display apparatus according to the first embodiment of the present invention.

FIGS. 8A to 8C are timing charts to explain the operation of common electrodes and segment electrodes in a conventional LCD apparatus when the liquid crystal display panel is turned ON in the full ON mode. The current consumed within 1 frame time period may be calculated as follows:

As to the voltage level of the common electrode, the below-mentioned 5 kinds of voltage levels are possible within 1 frame. That is, a point A (VDD/5 to 0); a point B (0 to VDD); a point C (VDD to (4/5)*VDD); a point D ((4/5)*VDD to VDD/5); and a point E (VDD/5 to (4/)*VDD).

The voltage level changes at the points A, B, C shown in FIG. 8A occur once within 1 frame for every common electrode. In the specific example, since the total number of common electrodes are 32, the voltage level changes occur 32 times. The voltage level changes at the points D and E shown in FIG. 8A occur 31 times within 1 frame for every common electrode. Since the total number of common electrodes are 32, the voltage level changes occur 992 (=32*31) times.

The current consumption is carried out based upon Q=CV, I=dQ/dt, namely I=CVf.

A current flowing at the points A, B and C in the common electrode within 1 frame may be calculated as follows:

$$I=C((1/5)VDD+VDD+(1/5)VDD)*32*100=4480C*VDD \quad (1)$$

A current flowing at the points D and E in the common electrode within 1 frame may be calculated as follow:

$$I=C((3/5)VDD+(3/5)VDD)*31*32*100=119040C*VDD \quad (2)$$

As a consequence, the current consumption may be calculated as 12350C*VDD due to the changes in the voltage levels of the common electrode within 1 frame.

As represented in FIGS. 8C and 8D, in the segment electrodes, a voltage level changes at the points A and B within 1 frame. The voltage changes at the points A and B shown in FIGS. 8C and 8D occur 32 times within 1 frame for every segment electrode. Since the total number of segment electrodes are 100, these voltage level changes occur 32*100 times. Similar to the above case of the common electrode, a current flowing at these points A and B may be calculated:

$$I=C*VDD*2*32*100*100=640000C*VDD \quad (3)$$

FIG. 8D represents the waveform of the voltage level in the conventional common electrode and segment electrodes when the liquid crystal display panel is turned ON in the full ON mode. The current which is consumed within 1 frame time period may be calculated in a similar manner to the above case, and the common electrode is similar to the above case. The voltage level change in the segment elec trode is different from the above-described case, and therefore, may be calculated as follows:

$$I=C*(1/5)VDD*2*32*100*100=128000C*VDD \quad (4)$$

As a result, the current consumption required in the conventional LCD drive circuit is given while the LCD panel is turned ON:

$$I=763520C*VDD \quad (5)$$

To the contrary, the current consumption required in the conventional LCD drive circuit is given while the LCD panel is turned OFF:

$$I=251520C*VDD \quad (6)$$

At the point B, the current consumption can be lowered in accordance with the first embodiment. When the LCD panel is turned ON in the full ON mode, the voltage level at the point B is equal to a voltage level "0" immediately before the line inverting timing, i.e., at the point B shown in FIG. 8 of the selected common electrode.

In the segment electrodes SEG1 to SEGn, the voltage level immediately before the line inverting timing, i.e., at the point B of FIG. 10 of the turn-ON data is equal to VDD. The voltage level in a case that the selected common electrode is short-circuited to all of the sequent electrodes SEG1 to SEGn becomes 1/2*VDD.

In the conventional LCD drive circuit, a change in the voltage level required to the selected common electrode at the line inverting timing is from "0" to "VDD". To the contrary, in the LCD drive circuit according to the first embodiment, a required voltage level change is from "1/2*VDD" to "VDD".

In the conventional LCD drive circuit, a change in the voltage levels required to all of the segment electrodes SEG1 to SEGn at the line inverting timing is from "VDD" to "0". To the contrary, in the LCD drive circuit according to the first embodiment, a required voltage level change is from "1/2*VDD" to "0". As a consequence, the current consumption required in the voltage level change of 1/2*VDD for both the common electrode and the segment electrodes can be reduced.

Within 1 frame, the reduced current consumption in the common electrode may be calculated as follows:

$$I=C(1/2VDD)*32*100=1600C*VDD \quad (7)$$

The current consumption in the segment electrode may be calculated as follows:

$$I=C(1/2VDD)*32*100*100=160000C*VDD \quad (8)$$

The current consumption of the common electrode when the LCD panel is turned OFF in the full ON mode is similar to the above-described case. Also, the current consumption of the segment electrodes when the LCD panel is turned OFF in the full ON mode can be reduced as follows:

$$I=C(1/10VDD)*32*100*100=32000C*VDD \quad (9)$$

As a consequence, the current consumption reduced in accordance with the LCD drive circuit of the first embodiment may be calculated as follows:

$$I=161600C*VDD \text{ (turned ON)} \quad (10)$$

$$I=33600C*VDD \text{ (turned OFF)} \quad (11)$$

After all, the current consumption of the LCD drive circuit according to the first embodiment of the present invention can be reduced by 21% (turn-ON state in the full ON mode) and 13% (turn-OFF state in the full OFF mode), respectively, as compared with that of the conventional LCD drive circuit.

Figure 9:
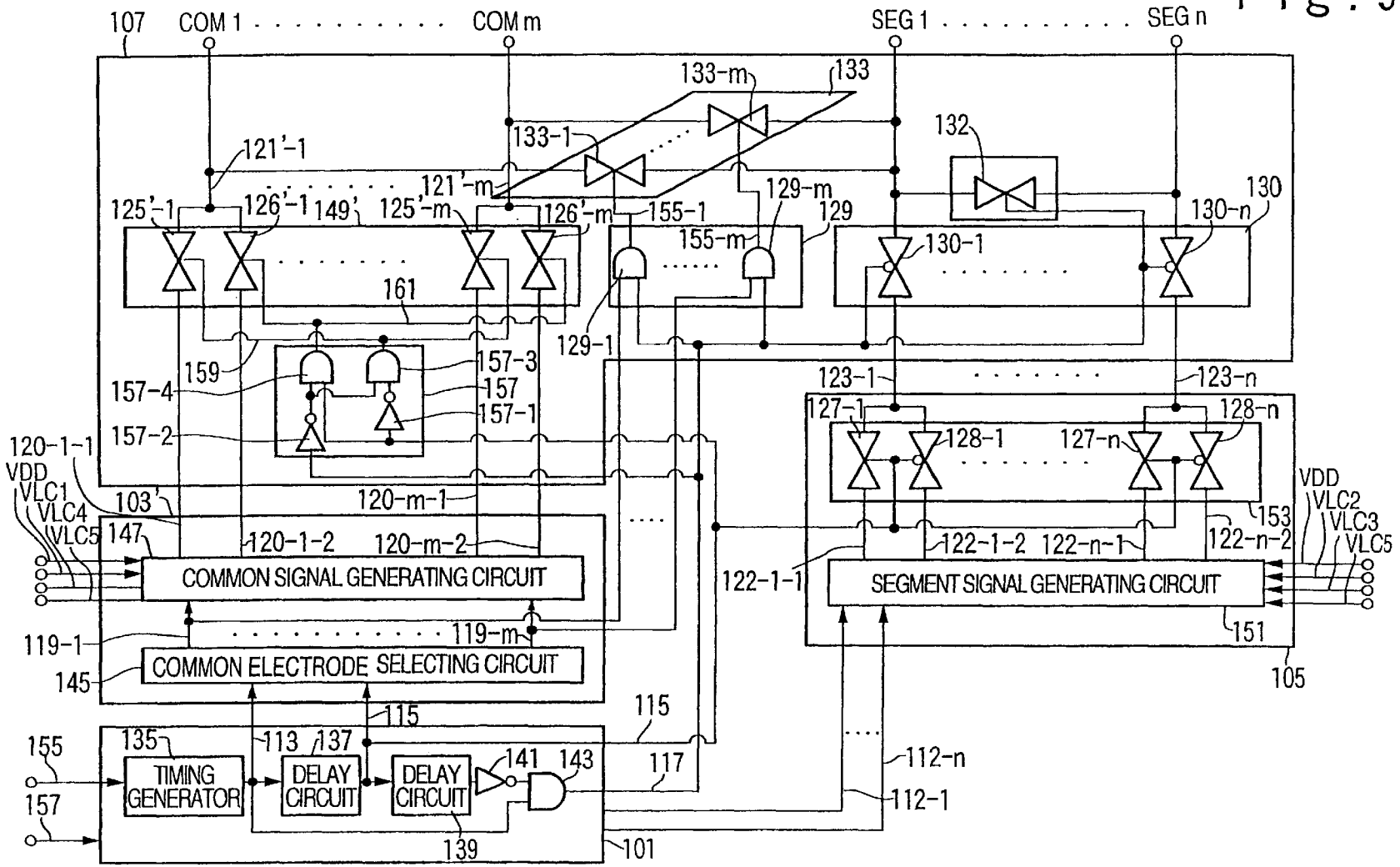
FIG. 9 is a block diagram illustrating the structure of the liquid crystal display apparatus with a drive circuit according to a second embodiment of the present invention.

FIG. 9 is a block diagram illustrating the construction of the liquid crystal display (LCD) drive circuit according to the second embodiment of the present invention. It should be noted that the same reference numerals or symbols shown in the first embodiment will be allocated to the same components as those shown in the first embodiment, and detailed descriptions thereof are omitted.

A switch pairs 126'-1 to 126'-m employed in the second LCD drive circuit may play a role of the first switch pairs 126-1 to 126-m and also a role of the second disconnection switches 131-1 to 131-m employed in the first LCD drive circuit. For example, when the selected common electrode is a common electrode COMm, the first switch pairs 125'-m and 126'-m disconnects the selected common electrode COMm from first and second common signals 120-m-1 and 120-m-2 while the second timing signal 117 is at a high level.

The liquid crystal display drive circuit according to the second embodiment is composed of a timing control unit 101, a common drive unit 103', a segment drive unit 105, and a logic switching unit 107'. The following operation is made under an assumption that the common electrode COMm is selected as the above-explained "selected common electrode".

The common drive unit 103' inputs the frequency-divided clock signal 113 and the first timing signal 115 to produce a selection signal 119-m. The common drive unit 103' allocates two of a plurality of first level signals to the selection signal 119-m, so that the first common signal 120-m-1 and the second common signal 120-m-2 are both generated. Two different voltage levels are allocated as the two first level signals to the first and second common signals.

The logic switching unit 107'selectively disconnects both of the first common signal 120-m-1 and the second common signal 120-m-2 from the selected common electrode COMm in response to the first timing signal 115 and the second timing signal 107.

The logic switching unit 107'selectively disconnects a plurality of segment electrodes SEG1 to SEGn from the segment signals 123-1 to 123-n in response to the selection signal 119-m and the second timing signal 117. The logic switching unit 107' short-circuits the disconnected common electrode COMm and the disconnected segment electrodes. The logic switching unit 107' is composed of a first disconnection switch group 130, a first short-circuit switch 132, a disconnection timing generating unit 157, a second switch pair group 149' an AND gate circuit group 129, and a second short-circuit switch group 133. The second switch group 149' is composed of first switch pairs (for example, 105'-m and 126'-m) corresponding to each of the common electrodes.

In response to the second timing signal 117, the first disconnection switch group 130 electrically disconnects the plurality of segment electrodes from the above-described segment signals. In response to the second timing signal 117, the first short-circuit switch 132 short-circuits the plurality of segment electrodes SEG1 to SEGn to each other.

The disconnection timing generating unit 157 is composed of a first inverter 157-1, a second inverter 157-2, a first AND-gate circuit 157-3, and a second AND-gate circuit 157-4. The disconnection timing generating unit 157 inputs both of the first timing signal 115 and the second timing signal 117 to generate a first disconnection instruction 159 and a second disconnection instruction 161. In response to the first disconnection instruction 159 and the second disconnection instruction 161, the first common signal 120-m-1 and the second common signal 120-m-2 are disconnected from the selected common electrode COMm.

In response to the first disconnection instruction 159 and the second disconnection instruction 161, the second disconnection switch pair group 149' electrically disconnects the selected common electrode COMm from the first common signal 120-m-1 and the second common signal 120-m-2.

The AND gate circuit group 129 is composed of the AND gate circuits 129-1 to 129-m corresponding to the respective common electrodes. The AND gate circuit 129-m inputs both of the second timing signal 117 and the selection signal 119-m to generate a short-circuit instruction 155-m. In response to the short-circuit instruction 155-m, the second short-circuit switch group 133 short-circuits the disconnected common electrode COMm to the plurality of segment electrodes short-circuited to each other.

Figures 10A, 10B, 10C, 10D, 10E, 10F, 10G, 10H, 10I, 10J, 10K:
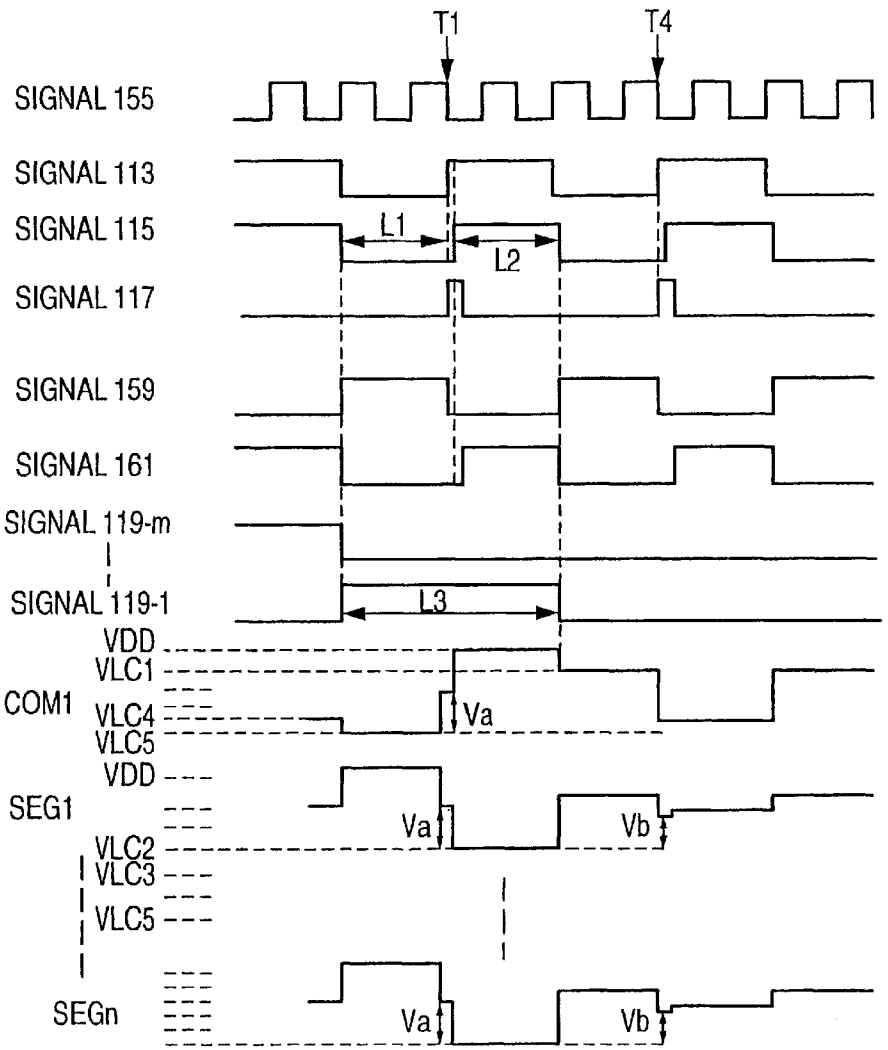
FIGS. 10A to 10K are timing charts for representing operations of the LCD drive circuit shown in FIG. 9.

FIGS. 10A to 10K are timing charts for describing operations of the LCD drive circuit according to the second embodiment. A waveform of the first disconnection instruction 159 is shown in FIG. 10E, and a waveform of the second disconnection instruction 161 is shown in FIG. 10F.

The rising timing of the first disconnection instruction 159 is made substantially coincident with the falling timing of the second disconnection instruction 161. The phase of the first disconnection instruction and the phase of the second disconnection instruction are substantially in the complementary relation except for the high-level time period of the second timing signal 117.

What is claimed is:

1. A display apparatus comprising:

a display panel having a plurality of common electrodes and a plurality of segment electrodes arranged in a direction orthogonal to said plurality of common electrodes, wherein display cells are formed at intersections of said plurality of common electrodes and said plurality of segment electrodes; and a logic switch unit which short-circuits selected ones of said plurality of common electrodes corresponding to a display cell group and selected ones of said plurality of segment electrodes corresponding to said display cell group in response to a common-segment short-circuit timing signal, wherein said display cell group includes selected ones of said display cells.

2. A display apparatus according to claim 1, wherein said logic switch unit short-circuits said selected segment electrodes in response to a segment short-circuit timing signal, before said selected common electrodes and said selected segment electrodes are short-circuited.

3. A display apparatus according to claim 1, wherein a number of said selected common electrodes is 1, and said common-segment short-circuit timing signal is generated before a line inverting operation to said common electrode.

4. A display apparatus according to claim 1, wherein said common-segment short-circuit timing signal is generated such that electric charge stored between said selected common electrode and said selected segment electrodes is redistributed.

5. A display apparatus according to claim 4, wherein when said stored charge substantially reaches a preset value, said selected common electrode is electrically disconnected from said selected segment electrodes.

6. A liquid crystal display drive circuit for driving a display panel having a plurality of common electrodes and a plurality of segment electrodes arranged in a direction orthogonal to said plurality of common electrodes, comprising:

a timing control unit which frequency-divides a clock signal to generate a first timing signal and a second timing signal from said frequency-divided clock signal, and inputs a display data to output a segment data corresponding to said plurality of segment electrodes;

a common electrode driving unit which generates a common selection signal based on said frequency-divided clock signal and said first timing signal to select one of said plurality of common electrodes, and generates a common drive signal used to drive said selected common electrode with a selected one of a plurality of first levels;

a segment electrode drive unit which generates a segment drive signal used to drive each of said plurality of segment electrodes with a selected one of a plurality of second levels; and a logic switch unit responsive to said common selection signal and said second timing signal to electrically disconnect said selected common electrode from said common drive signal, to electrically disconnect said plurality of segment electrodes from said segment drive signal, and to short-circuit said common electrode and said plurality of segment electrodes.

7. A liquid crystal display circuit according to claim 6, wherein said first timing signal is generated to start a line inverting operation to said selected common electrode, and said second timing signal is generated such that said selected common electrode is short-circuited to said plurality of segment electrodes before said line inverting operation.

8. A liquid crystal display circuit according to claim 6, wherein said timing control unit includes:

a frequency dividing unit which frequency-divides said clock signal to generate said frequency-divided clock signal based on a preset value;

a first delay unit which delays said frequency-divided clock signal based upon a preset time to output said first timing signal; and a second timing signal generating unit which generates said second timing signal based on said frequency-divided clock signal and said first timing signal such that said second timing signal is activated in synchronous with said frequency-divided clock signal, wherein said first timing signal is generated while said second timing signal is activated.

9. A liquid crystal display circuit according to claim 6, wherein said segment data are supplied to said segment electrode drive unit in parallel in correspondence with said plurality of segment electrodes.

10. A liquid crystal display circuit according to claim 6, wherein two different voltage levels are allocated to said common drive signal for said selected first level, and a voltage level of said common drive signal is changed in response to a falling timing of said second timing signal.

11. A liquid crystal display circuit according to claim 6, wherein two different voltage levels are allocated to said segment drive signal for said selected second level, and a voltage level of said segment drive signal is changed in response to a falling timing of said second timing signal.

12. A liquid crystal display circuit according to claim 6, wherein said logic switch unit includes:

a first disconnecting unit which electrically disconnects said plurality of segment electrodes from said segment drive signal in response to said second timing signal;

a first short-circuit unit which short-circuits said plurality of segment electrodes to each other in response to said second timing;

a disconnect instruction generating unit which generates a disconnect instruction based on said second timing signal and said common selection signal;

a second disconnecting unit which electrically disconnects said selected common electrode from said common drive signal in response to said disconnect instruction; and a second short-circuit unit which short-circuits said selected common electrode to said plurality of segment electrodes in response to said disconnect instruction.

13. A liquid crystal display drive circuit for driving a display panel having a plurality of common electrodes and a plurality of segment electrodes arranged in a direction orthogonal to said plurality of common electrodes, comprising:

a timing control unit which frequency-divides a clock signal to generate a first timing signal and a second timing signal from said frequency-divided clock signal, and inputs a display data to output a segment data corresponding to each of said plurality of segment electrodes;

a common electrode driving unit which generates a common selection signal based on said frequency-divided clock signal and said first timing signal to select one of said plurality of common electrodes, and generates first and second common drive signals used to alternately drive said selected common electrode with a selected one of a plurality of first levels;

a segment electrode drive unit which generates a segment drive signal used to drive each of said plurality of segment electrodes with a selected one of a plurality of second levels; and a logic switch unit which electrically disconnects said selected common electrode from said first and second common drive signals in response to said first and second timing signals, electrically disconnects said plurality of segment electrodes from said segment drive signal based on said common selection signal and said second timing signal, and short-circuits said selected common electrode and said plurality of segment electrodes.

14. A liquid crystal display circuit according to claim 13, wherein said first timing signal is generated to start a line inverting operation to said selected common electrode, and said second timing signal is generated such that said selected common electrode is short-circuited to said plurality of segment electrodes before said line inverting operation.

15. A liquid crystal display circuit according to claim 13, wherein said timing control unit includes:

a frequency dividing unit which frequency-divides said clock signal to generate said frequency-divided clock signal based on a preset value;

a first delay unit which delays said frequency-divided clock signal based upon a preset time to output said first timing signal; and a second timing signal generating unit which generates said second timing signal based on said frequency-divided clock signal and said first timing signal such that said second timing signal is activated in synchronous with said frequency-divided clock signal, wherein said first timing signal is generated while said second timing signal is activated.

16. A liquid crystal display circuit according to claim 13, wherein said segment data are supplied to said segment electrode drive unit in parallel in correspondence with said plurality of segment electrodes.

17. A liquid crystal display circuit according to claim 13, wherein said first and second common drive signals are alternatively switched based on said first and second timing signals.

18. A liquid crystal display circuit according to claim 13, wherein two different voltage levels are allocated to said segment drive signal for said selected second level, and a voltage level of said segment drive signal is changed in response to a falling timing of said second timing signal.

19. A liquid crystal display circuit according to claim 13, wherein said logic switch unit includes:

a first disconnecting unit which electrically disconnects said plurality of segment electrodes from said segment drive signal in response to said second timing signal;

a first short-circuit unit which short-circuits said plurality of segment electrodes to each other in response to said second timing;

a disconnect timing generating unit which generates first and second disconnect instructions based on said first and second timing signals;

a second disconnecting unit which electrically disconnects said selected common electrode from said first and second common drive signals in response to said first and second disconnect instructions; and a short-circuit instruction generating unit which generates a short-circuit instruction based on said second timing signal and said common selection signal such that said selected common electrode to said plurality of segment electrodes are short-circuited to each other in response to said short-circuit instruction.

* * * * *